United States Patent [19]

Campagnuolo et al.

[11] Patent Number: 4,852,496

[45] Date of Patent: Aug. 1, 1989

[54] CHARGING AND DETONATION DEVICE FOR SUBMUNITION

[75] Inventors: Carl J. Campagnuolo, Potomac; Jonathan E. Fine, Silver Spring, both of Md.

[73] Assignee: The United States of America as represented by the Secretary of the Army, Washington, D.C.

[21] Appl. No.: 276,251

[22] Filed: Nov. 25, 1988

[51] Int. Cl.[4] ..... F42B 3/00

[52] U.S. Cl. ..... 102/322; 102/283; 102/216

[58] Field of Search ..... 102/322, 283, 216

[56] References Cited

U.S. PATENT DOCUMENTS 3,853,066 12/1974 Campagnuolo et al. ..... 102/216
3,990,370 11/1976 Campagnuolo et al. ..... 102/2 X
4,027,593 6/1977 Campagnuolo et al. ..... 102/70.2 G
4,174,666 11/1979 Lucey, Jr. et al. ..... 102/70.2 G X

*Primary Examiner*—Peter A. Nelson
*Attorney, Agent, or Firm*—Saul Elbaum; Guy M. Miller; Thomas E. McDonald

[57] ABSTRACT

An environmental charging and detonation system for submunitions has an alternator in which a firing pin or rotor shaft is used for safing and arming, stab detonation, as well as the rotor for the alternator. A ram air actuated ribbon is deployed during submunition flight for arming the submunition and spinning the rotor of the alternator. The alternator generates energy that is stored in a charging circuit. A multidirection impact detection switch triggers a firing circuit that discharges the energy stored in the charging circuit through an electronic detonator. The electronic detonator will reliably detonate the submunition regardless of the submunition impact angle with a target.

7 Claims, 6 Drawing Sheets

CHARGING AND DETONATION DEVICE FOR SUBMUNITION

RIGHTS OF THE GOVERNMENT

The invention described herein may be manufactured, used and licensed by or for the United States Government for Governmental purposes without payment to me of any royalty thereon.

BACKGROUND OF THE INVENTION

1. Field of the Invention

The present invention is directed towards submunitions and grenades and, more particularly, to an environmental charging and detonation device for a submunition that provides more reliable performance and greater safety related thereto than conventional mechanically activated devices.

2. Description of the Prior Art

Many of the submunitions and grenades now in use require a mechanical firing pin to impact a stab detonator in order to detonate the explosives found in these devices. It has been demonstrated that a firing system relying on a firing pin to strike a stab detonator is not sensitive to impact angles significantly less than 90° with respect to a ground target. Consequently, the battlefield becomes contaminated with armed submunitions that can be triggered upon contact by vehicle or personnel walking though the battlefield.

An example of a present mechanical submunition firing system is exhibited in the Army's M223 fuze. This fuse is used in the Army's M42/M46 submunition grenades which are stacked one into the other and carried either by artillery projectile or rocket cargo rounds. At some height above a target the cargo round is blown open by a separate fuze and the arrays of submunitions from the projectile are dispersed to form an umbrella pattern. Each submunition contains its own M223 fuze which is armed on its way to the target. The stab firing pin in the M223 fuze is threaded along part of its length for securing it to the submunition housing in a safe position prior to arming. The firing pin is also used to secure a spring loaded slider containing a stab detonator. When the submunition is released from the cargo round a ribbon is deployed that unscrews the stab firing pin. This action releases the spring loaded slider, containing the stab detonator, causing the detonator to snap into alignment with the stab firing pin. The stab firing pin then functions the submunition, by striking the stab detonator, upon impact by the submunition with the ground or target. However, the required striking action by the firing pin in this fuze is very unreliable. Impact by the submunition must be very close to vertical with respect to the ground and with sufficient force in order for it to operate properly. Additionally, the ribbon deployed to unscrew the firing pin is unreliable. For slow or nonspinning rounds, such as exhibited by rockets, the ribbon does not generate enough spin on its own to unscrew the firing pin. Consequently, not only are current mechanical submunitions insensitive to oblique angles of impact they are also unreliably armed.

SUMMARY OF THE INVENTION

Accordingly, it is a primary object of the present invention to provide a submunition or grenade fuze that is more sensitive to oblique angles of impact with targets.

Another object of the invention is to provide a submunition or grenade fuse that is more reliably armed than present mechanical fuse systems.

Still another object of the invention is to provide a submunition or grenade fuze that is safer than conventional mechanical fuze systems.

A still further object of the invention is to provide a more reliable submunition or grenade fuze without extensive modification of existing fuze structures.

The foregoing and other objects are achieved in accordance with the invention through the use of an environmental charging and detonation system that can fit into the limited space of an existing submunition or grenade. The improvement thereto, which permits the use of an electrical firing circuit in an otherwise purely mechanical device, generally comprises the addition of an alternator having a stator and rotor operated by a ram air actuated energizing means for generating energy to be used by the firing circuit. A unique aspect of the invention is the addition of a multipole permanent magnet affixed to a firing pin in an existing device and then using the converted firing pin as the rotor for the alternator. The rotor is turned by the ram air actuated energizing means that trails the submunition. Various improvements in ribbon design result in sufficient spinning to turn the alternator rotor. Once energy has been generated by the alternator it is stored in a charging circuit. A multi-directional impact detection switch is included as part of the firing circuit. This switch is more sensitive to oblique target impacts than the current firing pin systems. The multi-direction impact switch is used to trigger the firing circuit, upon oblique target impacts, to detonate an electric detonator.

The present invention also has improvements in safety. More submunitions become properly armed and there are fewer submunition duds left unexploded after target impact. The ram air actuated energizing means deployed for releasing the rotor from its safe position is designed to reliably unscrew the rotor as well as spin the rotor sufficiently for the alternator to generate enough energy to fire the submunition.

The present invention provides an inexpensive and reliable fuze by using the firing pin for safing and arming, stab detonation, as well as making it an integral part of an alternator for generating electric charge. The fuze incorporates an environmental charging and detonation system to an existing submunition fuze concept, without adding significantly to complexity, but with an increase in cost due to the addition of the electrical back-up feature.

BRIEF DESCRIPTION OF THE DRAWINGS

The foregoing and other objects, aspects, uses and advantages of the present invention will be more fully appreciated as the same becomes better understood when considered in connection with the following detailed description of the present invention and in conjunction with the accompanying drawings, in which.

DESCRIPTION OF THE PREFERRED EMBODIMENTS

Figure 1:
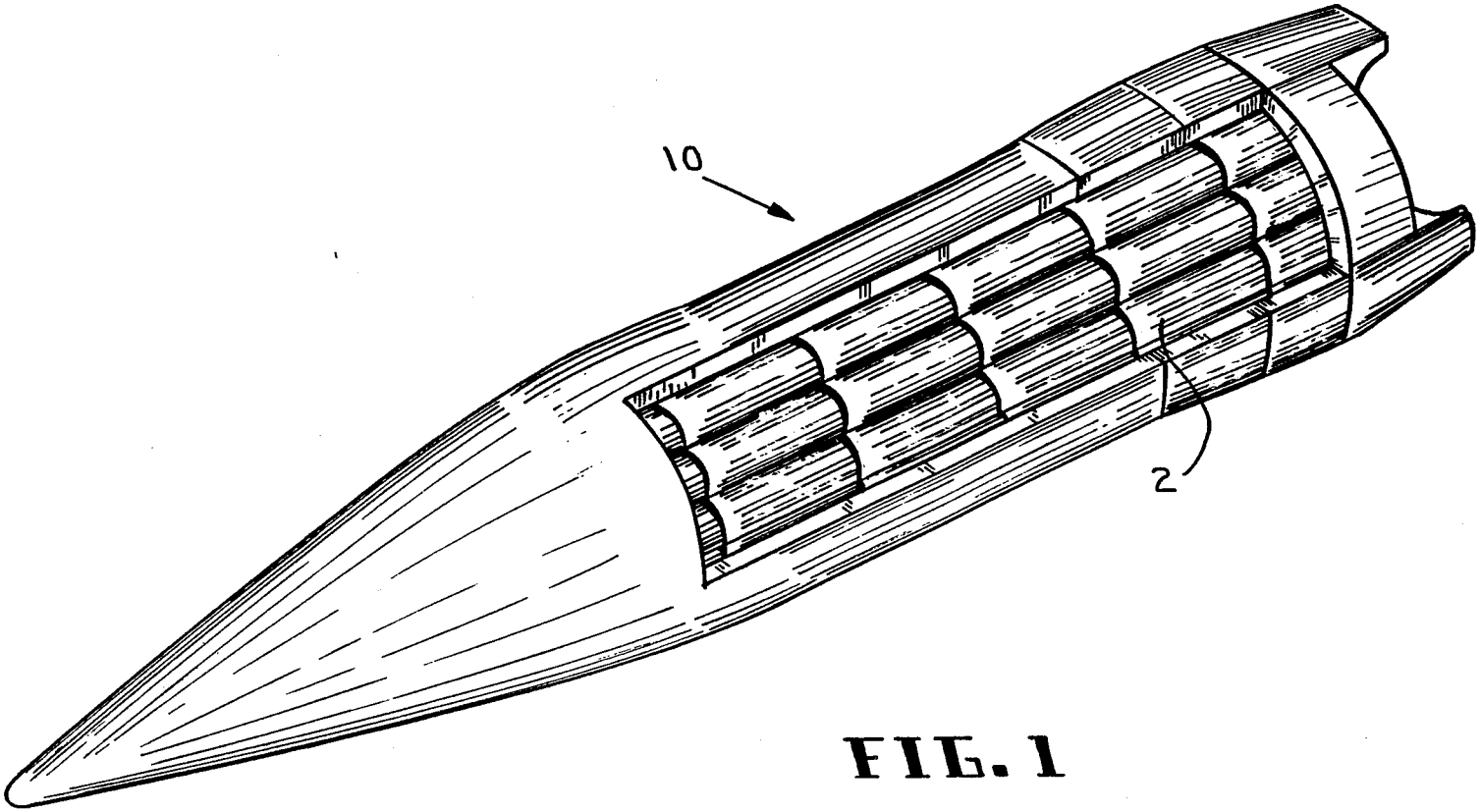
FIG. 1 shows a cut away perspective view of a typical cargo round projectile for carrying arrays of submunitions.

Referring now to the drawings, like reference numerals represent identical or corresponding parts throughout the several views.

Figure 2:
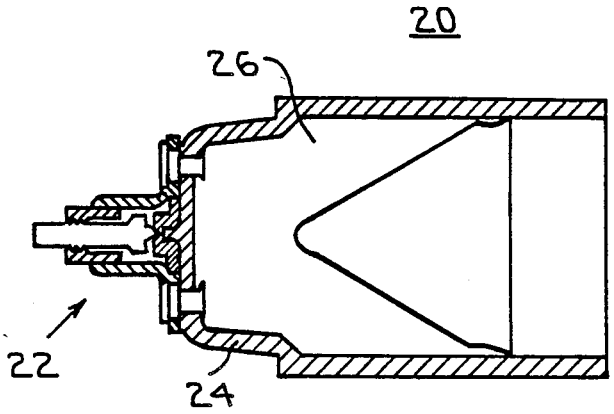
FIG. 2 (PRIOR ART)
FIG. 2 shows a half sectional view of a prior art mechanically activated submunition used in the cargo round of FIG. 1.

FIG. 1 shows a typical cargo round projectile 10 in which mechanically activated grenades or submunitions 2 are carried in a cylindrical array stacked one onto the other. At some height above a target the cargo round 10 is blown open by a fuze (not shown) which causes the array of submunitions to be expelled from the cargo round and dispersed to form an umbrella pattern. FIG. 2 shows a half sectional view of a typical mechanically activated submunition 20 in which a general purpose mechanical fuze 22 is mounted on a housing 24 which encloses a shaped explosive charge 26.

Figure 3:
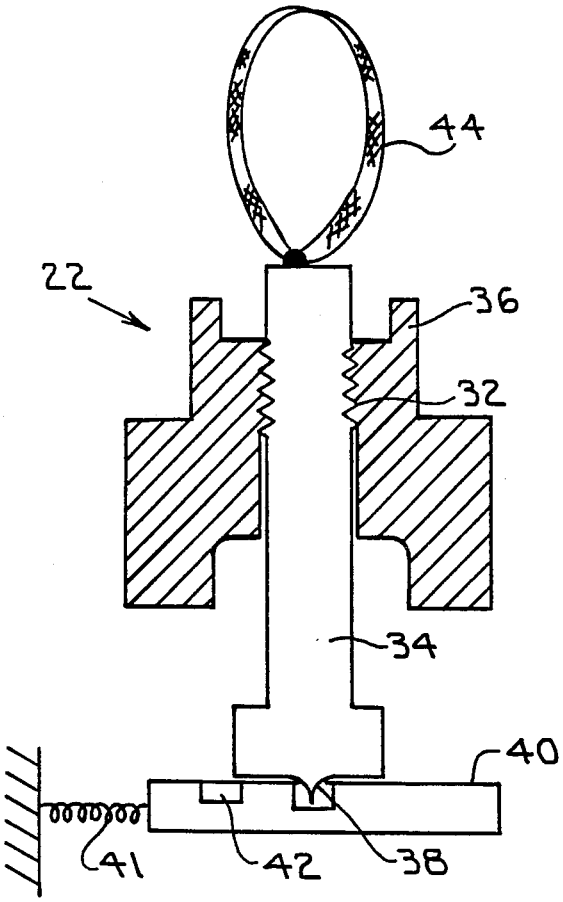
FIG. 3 (PRIOR ART)
FIG. 3 shows an internal configuration of a prior art mechanically activated submunition fuze.

FIG. 3 shows the internal design of the mechanical submunition fuze 22. When the fuze 22 is in its safe position the threads 32 of firing pin 34 are engaged with a weight 36. The pointed end 38 of firing pin 34 holds a spring loaded slider 40 in a position such that a stab detonator 42 is out of line with the firing pin 34. When the fuze 22 is expelled from the cargo round 10 and becomes airborne a ribbon 44 is deployed that rotates the firing pin 34 which disengages it from the weight. As the firing pin 34 is unscrewed it releases the spring loaded slider 40. A spring 41 causes the detonator 42 to snap into alignment with the firing pin 34 thus arming the fuze 22. When the submunition impacts a target, in a 90° orientation with respect to horizontal, the firing pin 34 within the fuze 22 is forced down striking the detonator 42. However, the firing pin 34 does not reliably strike the detonator 42 when the submunition strikes a target at angles less than 90° with respect to horizontal.

Figure 4:
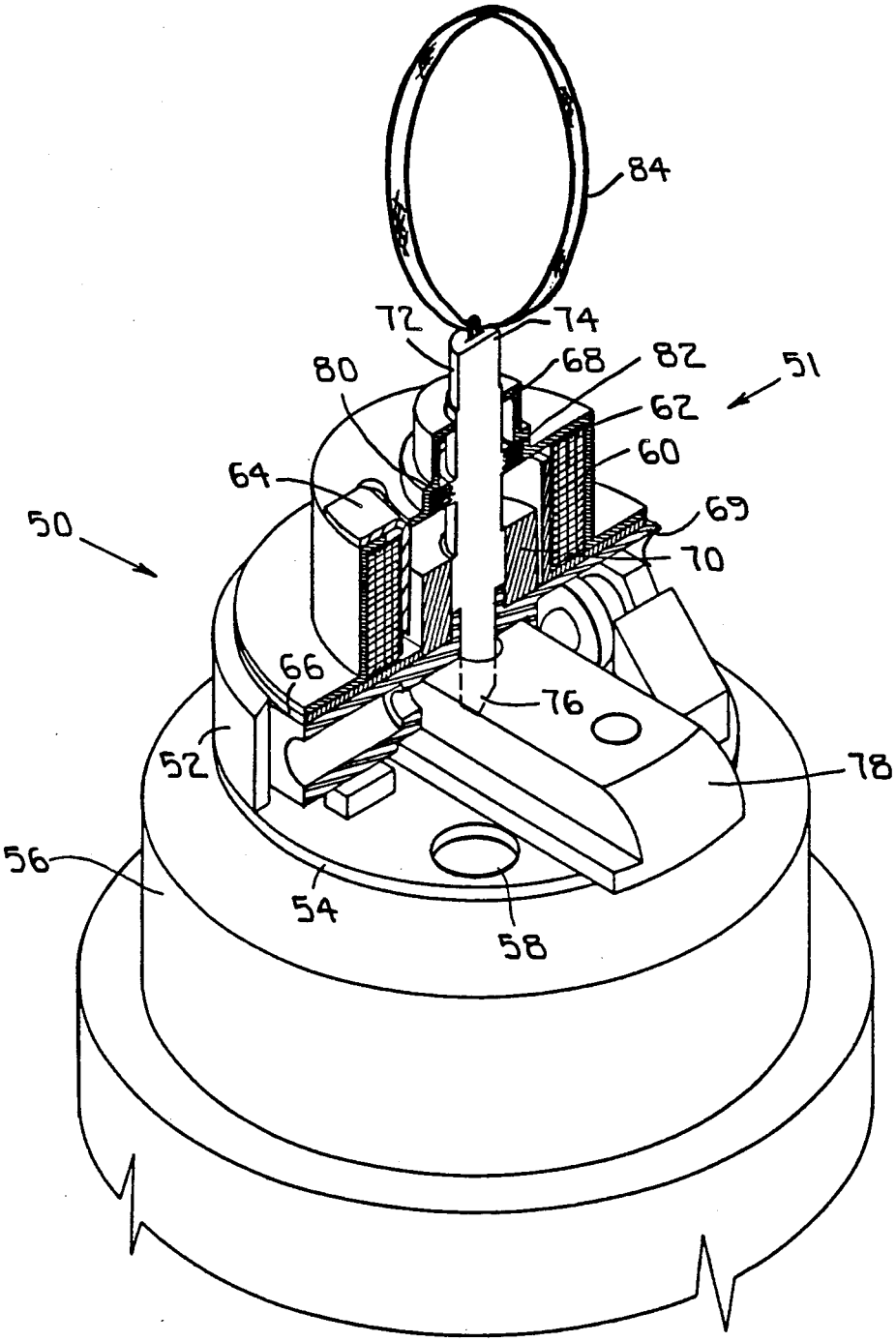
FIG. 4 shows a perspective view, partially in section, of an environmental charging and detonation device in a safe or unarmed mode according to an aspect of the invention.

FIG. 4 shows a perspective view, partially in section, of an environmental charging and detonation system 50 in a safe or unarmed mode according to an aspect of the invention. The environmental charging and detonation system or fuze 50 has a housing 52 with an electronics board base plate 54 mounted on a submunition 56 by using clinch studs (not shown) passing through a mounting stud clearance hole 58. The fuze 50 has an alternator 51 comprising; a coil assembly consisting of a coil 60 wrapped around a bobbin 62 and; a stator consisting of a permalloy stator top plate 64 and permalloy stator bottom plate 66, all enclosed within a stator casing 68 and alternator base 69. A multipole permanent magnet 70 is affixed to a firing pin or rotator shaft 72. The rotor shaft 72 has a first end 74 externally projecting from the housing 52 and stator casing 68 and a second substantially pointed end 76 that holds a spring loaded slider 78 in a safe position. While a straight slider is shown by way of example, various other configurations may be used. For example, a spring driven rotor, arm or cam could be use. The rotor shaft 72 is kept in an first position by threadedly engaging the shaft 72 with a threaded washer 82 thereby making the alternator 51 inoperable. A ribbon 84 (not shown to scale) is attached to the first end 74 of the rotor shaft 72. When the fuze 50 is released from a projectile the ribbon 84 is deployed and unfolds to its operating position by the action of ram air. A ribbon is used as the energizing means because it is easily folded around the housing allowing for compact stacking of submunitions. As the ram air spins the ribbon 84 it disengages the rotor shaft 72 from the threaded washer 82 and stator casing 68. The fuze 50 is now armed.

Figure 5:
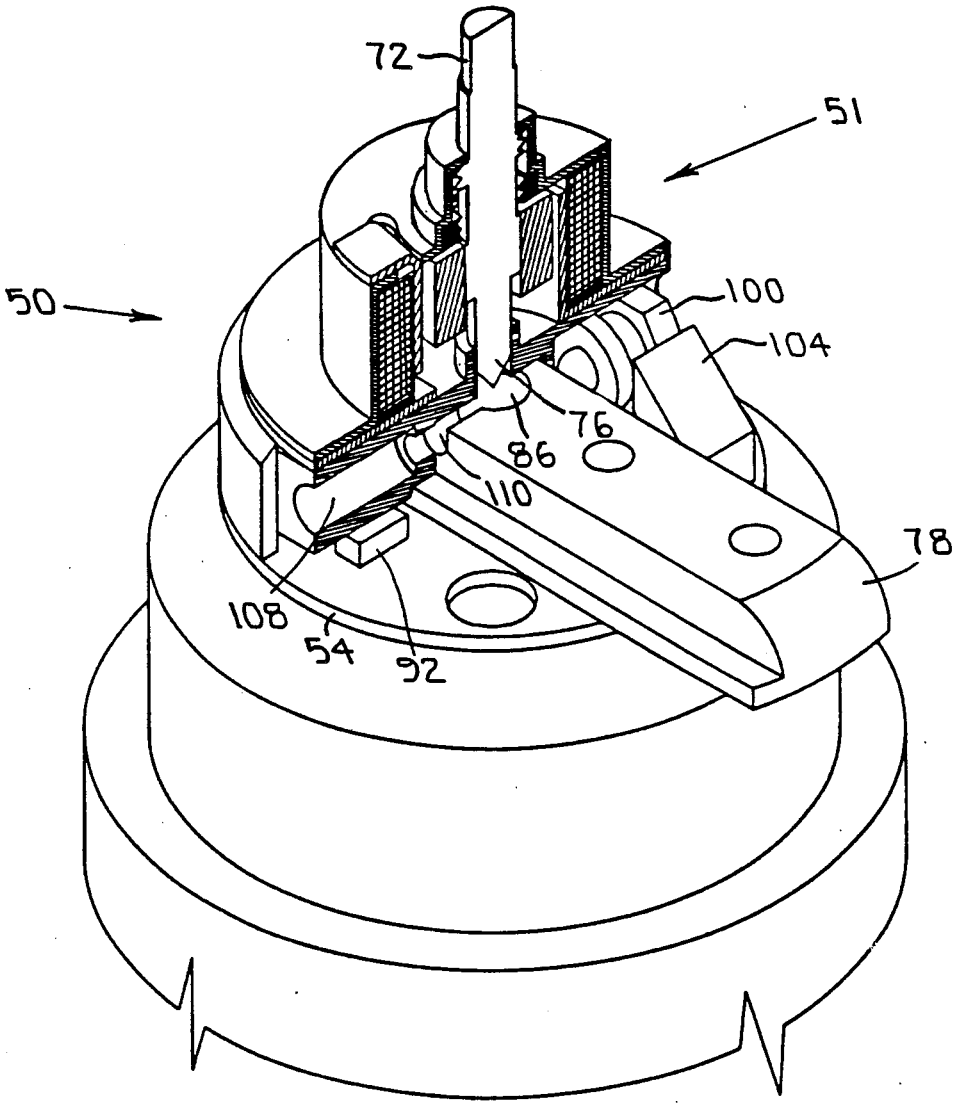
FIG. 5 shows a perspective view, partially in section, of an environmental charging and detonation device or fuze in an armed mode according to an aspect of the invention.

FIG. 5 shows a perspective view, partially in section, of an environmental charging and detonation system or fuze 50 in an armed mode according to an aspect of the invention. In the armed mode the rotor shaft 72 is disengaged from its inoperable first position to a operable second position where it is free to rotate by the action of the spinning ribbon 84. The spring loaded slider 78 is free to slide to a position that aligns the substantially pointed end 76 of the rotor shaft 72 with a stab detonator bore 86 within the slider 78 that holds a stab detonator (not shown). The ram air actuated ribbon 84 rotates the rotor shaft 72 which in turn causes the multipole permanent magnet 70 to rotate. The magnetomotive force of the magnet 70 transfers flux through the stator, and an emf is induced in the coil winding 60. While a two-pole alternator is shown in FIGS. 4 and 5 other multiple pole alternators may be used. For the two-pole configuration, the magnet 70 and stator each have two poles. Consequently, for every 360 degrees of rotation, the induced emf completes one electrical cycle. In a four pole configuration, the magnet and stator would each have four poles, so that the induced emf completes two electrical cycles for each 360 degrees of rotation. The power generated by the alternator 51 is used for charging and firing circuits which are mounted to electronics board base plate 54. The number of poles selected for the alternator 51 is determined by the amount of energy required by the firing circuit and the ability of the ram air actuated ribbon to spin the rotor shaft 72 of the alternator 51.

Figure 6:
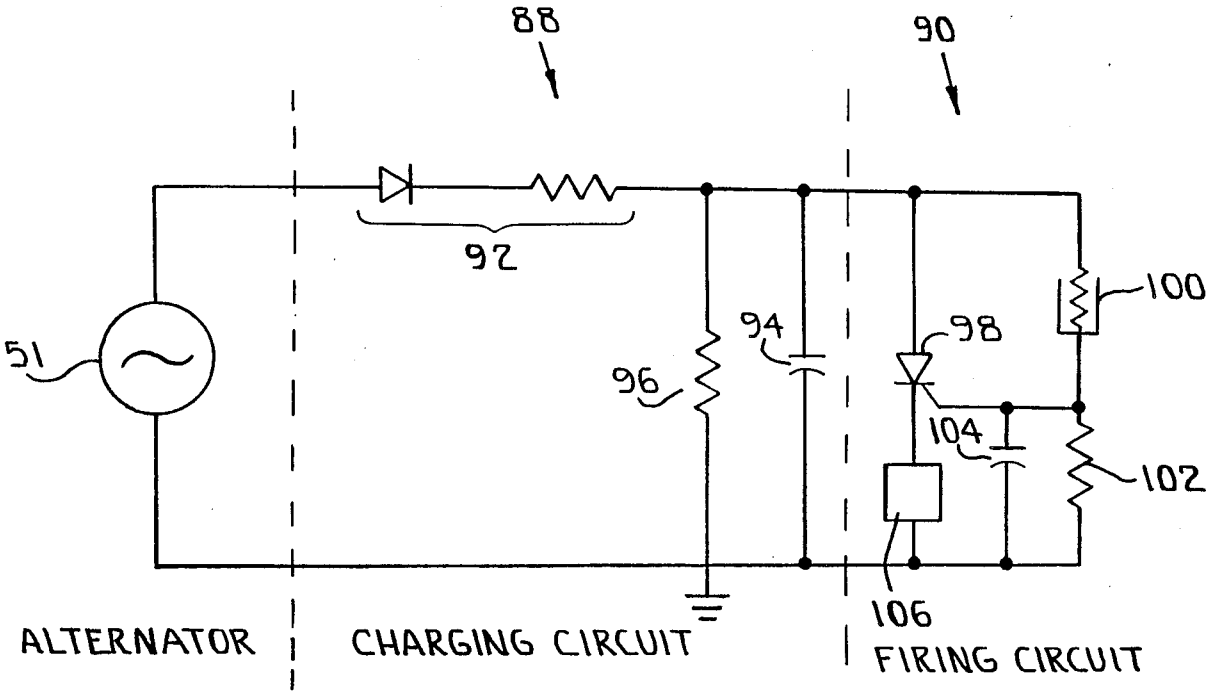
FIG. 6 shows an electrical schematic of an alternator with charging and firing circuits according to an aspect of the invention.

FIG. 6 shows a schematic of the alternator 51 with a charging circuit 88 and a firing circuit 90. The charging and firing circuits shown in FIG. 6 are disclosed merely by way of example and are not intended to limit the scope of the claimed invention. Charging circuit 88 comprises a rectifier resistor combination 92 connected to a parallel combination of a capacitor 94, which stores energy generated by the alternator 51, and a high resistance bleeder resistor 96. The resistor 96 is used to discharge the capacitor 94 in case of any charge that is present before arming. The capacitor 94 is connected to the firing circuit 90 which comprises an SCR 98, a multi-direction impact detection switch 100, a resistor 102 and a capacitor 104. An example of a multi-direction impact detection switch is disclosed in U.S. Pat. No. 4,174,666 entitled "Springless Impact Switch," by Lucey, Jr. et al. An electronic detonator 106 is connected to the SCR 98. When the submunition impacts a target the multi-direction impact detection switch 100 triggers the SCR 98 causing the energy stored in capacitor 94 to discharge through the SCR 98 and electronic detonator 106. The size of capacitor 94 is chosen so that the energy stored therein is sufficient to fire the electronic detonator 106. Resistor 102 and capacitor 104 are used to suppress voltage spikes caused by the impact detection switch 100.

Referring back to FIG. 5 certain electrical components are shown mounted on electronics board base plate 54. An electronic detonator bore 108 holds the electronic detonator (not shown). When the multidirection impact detection switch 100 senses a target it triggers the firing circuit 90. The electronic detonator 106 detonates causing explosive charge to propagate through a propagation channel 110, within the spring loaded slider 78, to the stab detonator. The stab detonator then detonates the explosive in the submunition. As an alternative design, the electronic detonator can be mounted within the spring loaded slider.

Figures 7, 8A, 8B, 8C, 8D:
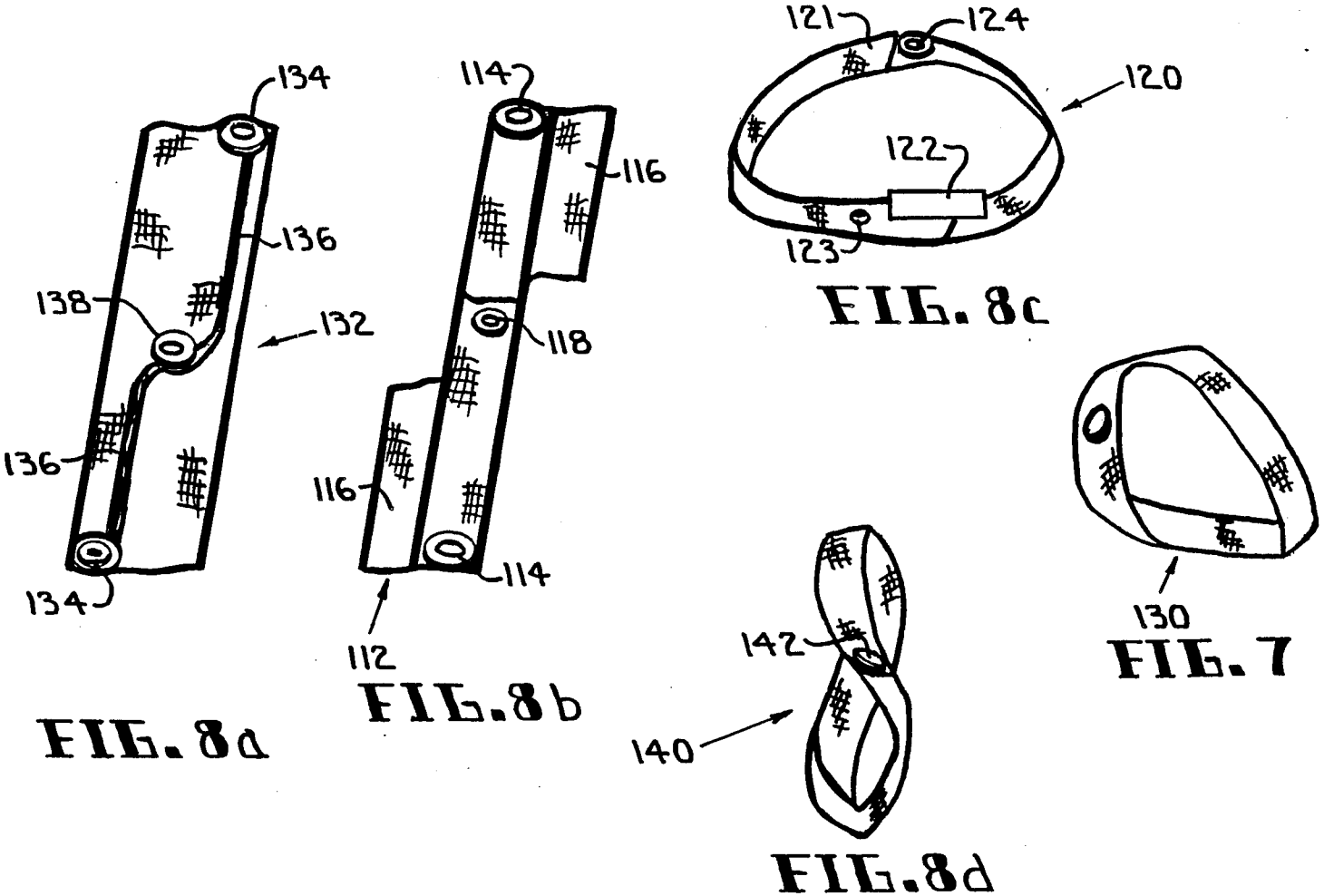
FIG. 7 shows a prior art design of a trailing ribbon.
FIGS. 8*a*–8*d* show various designs of trailing ribbons according to aspects of the invention.

FIG. 7 shows a prior art ram air actuated energizing means or ribbon loop 130. FIGS. 8*a*–8*d* show improvements in ribbons that can sufficiently spin the alternator's rotor shaft 72. For the rotor shaft 72 and magnet 70 to spin, the restoring torque caused by the attraction between each magnet pole and its magnetic image in the corresponding stator pole must be exceeded by an external torque applied to the rotor shaft 72. Consequently, the ribbon used to spin the rotor shaft 72 must be able to overcome this magnet rotor attraction. The ribbon must also be able to spin even if the submunition is released from a nonspinning cargo round. One possible configuration is shown in FIG. 8*a*. It shows a straight 5 inch flexible flat ribbon strip 132 having snaps or weights 134 and a plurality of leading edge slots 136. The ribbon strip 132 is attached at its center 138 to the end 74 of rotor 72. FIG. 8*b* shows a straight 5 inch flexible flat ribbon strip 112 having snaps or weights 114 and vanes 116 on each end of the strip. The straight ribbon strip 112 is attached at its center 118 to the end 74 of rotor 72. After the straight ribbon strips 132 and 112 are deployed and unfolded due to the action of ram air on the submunition the weights 114 and 134 and slots 136 on strip 132 or vanes 116 on strip 114 help the straight ribbon strips behave like propellers. Consequently, spin is imparted to the rotor 72 even if the submunition is released from a nonspinning cargo round. FIG. 8*c* shows an approximately 4 inch flexible ribbon loop 120 with leading edge slots 121 in which a stiffener with vanes 122 is attached at a point 123 on the flexible ribbon loop 120 opposing the point 124 on the flexible ribbon loop 120 that is used to attach the loop 120 to the end 74 of rotor 72. Providing leading edge slots 121 improve the stability of the loop and tends to "inflate" the ribbon and maintain its loop shape. FIG. 8*d* shows a figure eight shaped flexible ribbon loop 140 that is attached at the cross over 142 to the end 74 or rotor 72. All of these ribbons spin under the influence of ram air. Obviously, the size and particular dimensions of the various ribbons will depend on the particular application involved. These ribbons are more reliable in arming the fuze 50 than previous circular ribbons that trailed submunition rounds due to their configurations that promote and maintain spinning even when released from nonspinning cargo rounds. These ribbons also provide sufficient spinning to cause the alternator 51 to properly charge the charging circuit 88.

Obviously, numerous modifications and variations of the present invention are possible in light of the above teachings. It is therefore to be understood that within the scope of the appended claims, the invention may be practiced otherwise than as specifically described herein.

What is claimed is:

1. An environmental charging and detonation system for providing detonation energy to a submunition having an explosive charge without the use of external charging equipment comprising:

a housing mounted onto said submunition;

a charging circuit enclosed within said housing having energy storage means;

an alternator electrically connected to said charging circuit, said alternator comprising a stator enclosed within said housing, a rotor shaft located along the longitudinal portion of said housing having a first end projecting external to said housing and a second substantially pointed end, and a multipole permanent magnet affixed to said rotor shaft;

means for engaging said rotor shaft to said housing in a first position so that said alternator is inoperative;

a ram air actuated energizing means, attached to the first end of said rotor shaft, for disengaging said rotor shaft from the first position to a second position where said rotor shaft is free to rotate and for rotating said rotor shaft upon the introduction of ram air, the rotation of said rotor shaft causing said alternator to generate electrical energy which is stored in the energy storage means in said charging circuit;

an electrical firing circuit electrically connected to the energy storage means in said charging circuit, said electrical firing circuit comprising impact detecting means, securely mounted to said housing, for triggering the discharge of said energy storage means in said charging circuit;

mechanical detonating means, operated by impact of the substantially pointed end of said rotor shaft upon said mechanical detonating means, for detonating said explosive charge upon submunition impact; and electrical detonating means, operated by said electrical firing circuit, for detonating said explosive charge upon submunition impact.

2. The environmental charging and detonation system of claim 1 further comprising:

a spring loaded slider positioned in perpendicular relation to the substantially pointed end of said rotor shaft wherein said electrical detonating means and mechanical detonating means are disposed thereon, said slider is driven by a spring when said rotor shaft is disengaged from the first position so that the mechanical detonating means moves longitudinally under the substantially pointed end of said rotor shaft.

3. The environmental charging and detonation system of claim 1 wherein said ram air actuated energizing means comprises:

a generally rectangular flexible ribbon strip, attached substantially at its center to the first end of said rotor shaft, having first and second ends with weights attached thereto and having a plurality of slots aligned parallel and adjacent to a first edge of said ribbon strip extending along said first edge from said first end to its center.

4. The environmental charging and detonation system of claim 1 wherein said ram air actuated energizing means comprises:

a generally rectangular flexible ribbon strip, attached substantially at its center to the first end of said rotor shaft, having first and second ends with weights attached thereto and having vanes attached on opposite edges of said ribbon strip.

5. The environmental charging and detonation system of claim 1 wherein said ram air actuated energizing means comprises:

a flexible ribbon loop, attached at a first position on said ribbon loop to the first end of said rotor shaft, having a stiffener with vanes attached at a second position on said ribbon loop opposing said first position on said ribbon loop and having a plurality of slots aligned parallel and adjacent to a first edge of said ribbon loop extending along said first edge from said first position to said second position.

6. The environmental charging and detonation system of claim 1 wherein said ram air actuated energizing means comprises:

a figure eight shaped flexible ribbon loop, attached at the cross over of said figure eight shaped flexible ribbon loop to the first end of said rotor shaft.

7. An environmental charging and detonation system for providing detonation energy to a submunition having an explosive charge without the use of external charging equipment comprising:

a housing mounted onto said submunition;

a charging circuit enclosed within said housing having energy storage means;

an alternator electrically connected to said charging circuit, said alternator comprising a stator enclosed within said housing, a rotor shaft located along the longitudinal portion of said housing having a first end projecting external to said housing and a second substantially pointed end, and a multipole permanent magnet affixed to a position on said rotor shaft for transferring magnetic flux through said stator;

means for engaging said rotor shaft to said housing in a first position so that said alternator is inoperative;

a ram air actuated energizing means, mounted to the first end of said rotor shaft, for disengaging said rotor shaft from the first position to a second position where said rotor shaft is free to rotate and for rotating said rotor shaft upon the introduction of ram air, the rotation of said rotor shaft causing said alternator to generate electrical energy which is stored in the energy storage means in said charging circuit;

an electrical firing circuit electrically connected to the energy storage means in said charging circuit, said electrical firing circuit comprising impact detecting means, securely mounted to said housing, for triggering the discharge of said energy storage means in said charging circuit;

mechanical detonating means, operated by impact of the substantially pointed end of said rotor shaft upon said mechanical detonating means, for detonating said explosive charge upon submunition impact;

electrical detonating means, operated by said firing circuit, for detonating the mechanical detonating means in said submunition upon detection of submunition impact by said impact detecting means which then detonates said explosive charge.

a spring loaded slider positioned in perpendicular relation to the substantially pointed end of said rotor shaft wherein said electrical detonating means and mechanical detonating means are disposed thereon, said slider is driven by a spring when said rotor shaft is disengaged from the first position so that the mechanical detonating means moves longitudinally under the substantially pointed end of said rotor shaft.

* * * * *